United States Patent [19]

Sulprizio

[11] 4,377,288

[45] Mar. 22, 1983

[54] TENNIS RACKET

[76] Inventor: Michael S. Sulprizio, 4909 Goni Rd., Carson City, Calif. 89701

[21] Appl. No.: 253,903

[22] Filed: Apr. 13, 1981

[51] Int. Cl.[3] ..... A63B 51/02

[52] U.S. Cl. ..... 273/73 D

[58] Field of Search ..... 273/73 D, 76

[56] References Cited

U.S. PATENT DOCUMENTS

| | | | |
|---|---|---|---|
| 3,023,483 | 3/1962 | Steiner | 273/73 D X |
| 3,926,431 | 12/1975 | DeLorean | 273/73 D |
| 4,005,863 | 2/1977 | Henry | 273/73 D |
| 4,249,731 | 2/1981 | Amster | 273/73 D |

FOREIGN PATENT DOCUMENTS

| | | | |
|---|---|---|---|
| 2642978 | 3/1978 | Fed. Rep. of Germany | 273/73 D |
| 781583 | 2/1935 | France | 273/76 |
| 428582 | 5/1935 | United Kingdom | 273/76 |
| 1437505 | 5/1976 | United Kingdom | 273/73 D |

*Primary Examiner*—Richard C. Pinkham
*Assistant Examiner*—Matthew Schneider
*Attorney, Agent, or Firm*—Robert W. Dilts

[57] ABSTRACT

A tennis racket strung with a string grid, each strand of which has a cross-section defining a polygon with concave sides thus providing the grid strands with longitudinally extending concave surfaces which meet to form longitudinally extending sharp edges. At each junction between the strands of the string grid the sharp edges contact each other only at four sharply defined spaced points thus locking the strands to each other at each junction. In weaving the string grid substantial rectilinearity of the concave surfaces and sharp edges of the strands is maintained.

9 Claims, 6 Drawing Figures

TENNIS RACKET

DESCRIPTION

FIELD OF THE INVENTION

This invention relates to tennis rackets and more particularly to a tennis racket having an improved stringing.

BACKGROUND OF THE INVENTION

A tennis racket comprises a handle attached to a frame, which frame is provided with stringing in the form of a grid having a pair of mutually perpendicular arrays of strands. In the prior art, such strands are usually of generally circular cross-section and the strands of the pair of arrays are usually woven so that each strand of each array passes on opposite sides of each adjacent pair of strands in the other array.

Thus, the faces of the grid formed by arrays of strands present a foraminous surface to a resilient tennis ball which is impacted thereby. Such foraminous surface tends to grip the surface of the tennis ball and enables various desired spins to be imparted to the tennis ball depending on the relative movement which occurs between such surface and the ball during impact.

However, the force of the impact is distributed over the convex surfaces of the portions of strands in the arrays forming the grid which are impacted by the ball, thereby tending to reduce the frictional forces which impart the desired spin to the ball. Furthermore, the contact between the strands of one array and the strands of the other array is essentially a single point contact between the convex generally circular exterior surfaces of the strands. Although such contact will provide high frictional forces, it will not prevent the rolling of the convex generally circular surfaces of strands on each other. Such rolling will not only tend to attenuate the forces which would otherwise impart spin to an impacted tennis ball but will also tend to displace the strands from their desired location in the arrays.

It has been proposed in the prior art that the above problems can be reduced by forming the strands of the arrays of the grid of a tennis racket with generally flat side surfaces to produce an angular cross-section defining at least two edges and with the side surfaces and edges being helically shaped. (See U.S. Pat. No. 4,005,863, issued to Dana R. Henry on Feb. 1, 1977.) However, although the approach may provide some slight increase in the frictional forces between the strands and the ball upon impact over that provided by strands of circular cross-section, it tends to reduce the frictional forces between the strands themselves by tending to provide surface-to-surface contact instead of point-to-point contact. Thus, the strands of the arrays will slide on each other, resulting in serious dislocation of the strands of the arrays in use as well as attenuation of forces tending to impart spin to the ball. Furthermore, any increase in frictional forces between the strands and the ball upon impact due to the ridges provided by the angular cross-section of the strands in accordance with this prior art approach will tend to be negated by their helical form and flat side surfaces. The helical form will result in the ball impacting on generally flat surfaces equal in extent to the desired ridged surfaces and a resulting equalization in frictional forces between the strands and an impacted ball.

It is the object of this invention to provide an improvement overcoming the deficiencies of the prior art as set forth above.

SUMMARY OF THE INVENTION

A tennis racket comprises a frame having a handle with a string grid mounted within the frame. The string grid comprises a pair of mutually perpendicular arrays of a plurality of strands with each strand of each array extending across the frame and passing on opposite sides of each adjacent pair of strands in other array. In a tennis racket according to this invention, each strand of each array has a cross-section defining a polygon with a concave longitudinally extending surface forming each side thereof.

BRIEF DESCRIPTION OF THE DRAWING

This invention will be more fully understood from a reading of the following detailed description of preferred embodiments thereof in conjunction with the drawing forming part of this specification and in which.

DETAILED DESCRIPTION OF PREFERRED EMBODIMENTS

Figure 1:
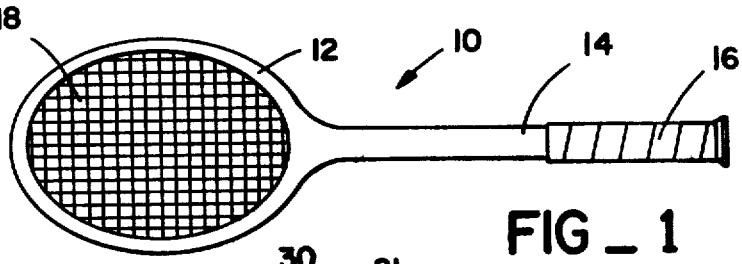
FIG. 1 is a plan view of a tennis racket according to a preferred embodiment of this invention.

Referring to FIG. 1, a tennis racket 10 is shown comprising a frame 12 with an attached handle 14. The handle 14 is provided with a hand grip 16 and a string grid 18 is mounted within the frame 12.

Figure 2:
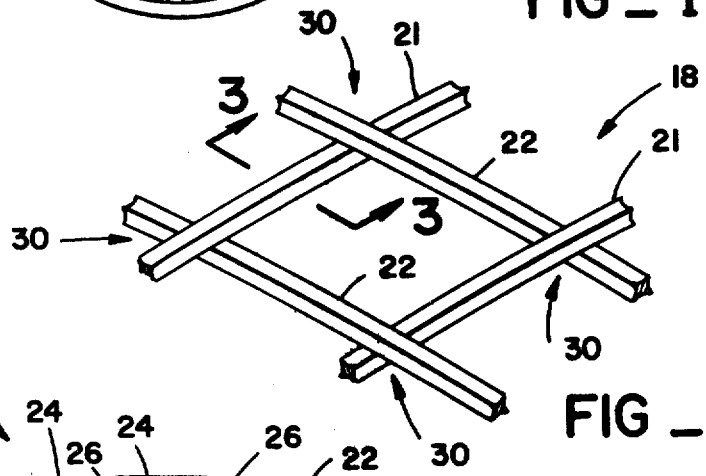
FIG. 2 is an enlarged fragmentary perspective view of a portion of the string grid mounted within the frame of the tennis racket of FIG. 1.

Referring to FIG. 2, the string grid 18 comprises a first plurality of strands 21, arranged in a first mutually parallel array and a second plurality of strands 22 arranged in a second mutually parallel array which is perpendicular to the first array of strands 21. Each strand 21 of the first array passes on opposite sides of each adjacent pair of strands 22 in the second array. Similarly, each strand 22 of the second array passes on opposite sides of each adjacent pair of strands 21 in the first array. Thus, the string grid is woven in such a way as to insure that the junctions between the strands of the two arrays will be maintained in mutual compression.

Figure 3:
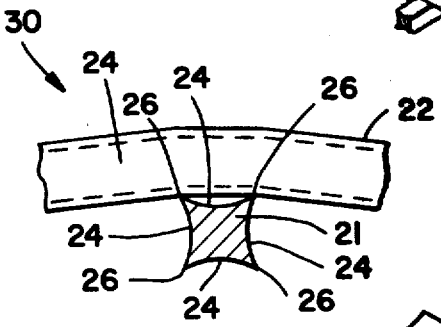
FIG. 3 is an enlarged fragmentary view partially in cross-section of a junction between strands of the string grid taken along line 3—3 of FIG. 2.

Referring to FIG. 3, the strands 21 and 22 of the string grid 18 according to a preferred embodiment of this invention may be extruded of a resin material currently used in racket stringing to provide a cross-section defining a four-sided polygon having concave longitudinally extending side surfaces 24. Thus, the junction between each adjacent pair of longitudinally extending side surfaces 24 will define a sharp longitudinally extending edge 26 along the strands. According to this invention, the strands 21 and 22 are extruded to provide rectilinear edges 26 and the string grid 18 is woven in such a way as to maintain substantial rectilinearity of the edges 26. In other words, care must be taken during the weaving process to reduce the twisting on the strands toward minimum. It has been found that any twisting of the strands according to this invention which may occur during the weaving process may be easily limited to not more than one-half turn between any one pair of adjacent junctions with full rectilinearity occurring between the majority of the junctions.

Figure 4:
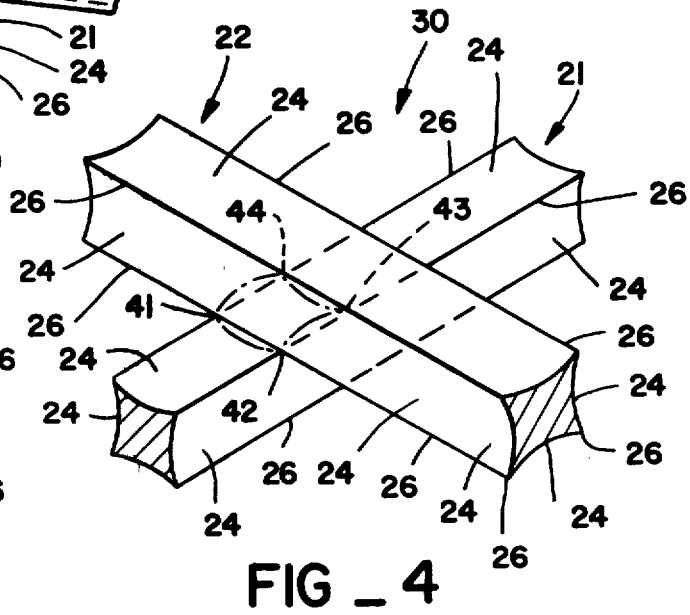
FIG. 4 is a further enlarged perspective view of the junction FIG. 3.

From the above, and as best shown in FIG. 4, it will be understood that at each junction 30 between the strands 21 and 22 of the string grid 18, the edges 26 of the strands 21, 22 will always contact each other only at four sharply defined points 41, 42, 43 and 44, regardless of any twisting which occur during the weaving process. The dashed lines in FIG. 4 represent the projection on the opposed surfaces 24 of the strands 21 and 22 of the edges 26 thereof in order to more clearly emphasize the contact points 41, 42, 43 and 44 between the opposed edges 26. Since the contact points 41, 42, 43 and 44 are under mutual compression, the edges 26 will tend to bite into or grip each other at such points. Thus, large frictional forces will oppose any tendency of the strands 21 to slide laterally along each other. Furthermore, upon impact by a tennis ball, the forces imposed on the strands 21 and 22 which might tend to cause the strands to roll on each other will be strongly opposed by the four point contact between the strands. Finally, the contact between the ball and the strands will occur at the edges 26 of the strands, enabling increased spin to be applied to the ball by the relative motion between the racket 10 and the ball.

It will be understood that the string grid 18 according to this invention, may comprise a single extruded element, having the cross-section shown in FIGS. 3 and 4 and described hereinabove, woven in the racket in the conventional manner to provide the mutually perpendicular arrays of strands. It is preferred that the substantial rectilinearity of the edges 26 of the strands be maintained as discussed above during conventional weaving processes for mounting the string grid 18 within the frame 12 of the tennis racket 10 since any twisting which may occur tends to impose undesirable internal stresses on the strands. Obviously the string grid 18 could also be woven from a plurality of lengths of strands having the cross-section shown in FIGS. 3 and 4, as well as from a single length and the arrays of such strands need not be perpendicular in alternate woven embodiments, although the embodiment shown in the drawing is preferred.

Figure 5:
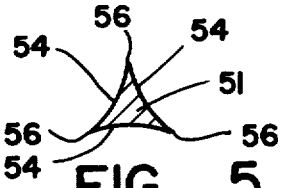
FIG. 5 is a cross-sectional view similar to the cross-sectional portion of FIG. 3, showing the cross-section of a strand according to an alternate embodiment of this invention.

Referring to FIG. 5, an alternate embodiment of this invention is shown in which the cross-section of the strand 51 defines a triangular polygon having concave longitudinally extending sides 54. The adjacent concave sides 54 meet to form sharply defined edges 56. Thus, at the junctions 30 between strands, according to this embodiment of the invention, at least a pair of contact points will be provided which will prevent the rolling of the strands on each other and it has been found that four point contact will almost always occur. As discussed hereinabove, the contact points will be under mutual compression tending to cause the edges 56 to bite into or seize each other to prevent longitudinal slippage of the strands with respect to each other. At the same time, a ball impacted by the string grid formed by weaving strands having the cross-section of the strand 51 of FIG. 5, will encounter the sharp edges 56, which form the apeces of the triangular cross-section, enabling a great deal of spin to be imparted to the ball. However the strand 51 will have a smaller cross-sectional area than the strands 21, 22 and it may not be possible to subject the strand 51 to the same tension as may be applied to the strands 21 and 22 with the same life expectancy.

Figure 6:
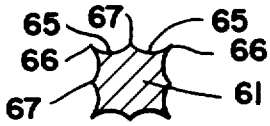
FIG. 6 is a cross-sectional view similar to the cross-sectional portion of FIG. 3, showing the cross-section of a strand according to a further embodiment of this invention.

Referring to FIG. 6, a further embodiment of the teaching of this invention is shown in which a strand 61 is provided with more than one longitudinally extending concave surface 65 on each side 64 thereof. Thus, an edge 67 will be provided intermediate the edges 66 at the corners of the polygonal shape defined by the cross-section of the strand 61. In the embodiment of this invention utilizing the strand 61 of FIG. 6, there will be nine contact points at each junction 30. However, the mutual compression at each contact point will be smaller than that present at the four contact points of FIG. 4 or the two contact points of FIG. 5. In addition, the concavity of the surfaces 65 will be smaller, allowing greater surface contact with a ball impacted thereby tending to reduce the frictional forces and the amount of spin that may be imparted to the ball as compared to the embodiment of FIGS. 3 and 5. However, a strand 61 according to this embodiment may be subjected to very substantial tensile forces and will tend to provide long life in addition to improved characteristics as compared to the prior art.

It is believed that those skilled in the art will make obvious changes in the embodiments of this invention shown in the drawing without departing from the scope of this invention as defined in the claims. For example, strands of the cross-section shown in FIGS. 3, 5 and 6 may be interwoven with each other in forming a particular string grid 18. In addition, the proportions of the cross-sections of the various embodiments may be varied from that shown in the drawing.

What is claimed is:

1. A tennis racket comprising a frame having a handle and a string grid mounted within said frame, said string comprising a pair of mutually transverse arrays of a plurality of strands, said strands having their ends affixed to said frame with each strand of each array extending across said frame and passing on opposite sides of each adjacent pair of strands in the other array, each strand of each array having a cross-section defining a polygon with a longitudinally extending concave surface on each side thereof, adjacent ones of said longitudinally extending concave side surfaces meeting to define sharp longitudinally extending edges and each junction between strands of said pair of arrays providing compressive contact at four sharply defined spaced points with the surfaces between said points spaced from each other.

2. A tennis racket as claimed in claim 1 wherein a plurality of said strands of said string grid have a cross-section defining a four sided polygon.

3. A tennis racket as claimed in claim 1 wherein a plurality of said strands of said string grid have a cross-section defining a three sided polygon

4. A tennis racket as claimed in claim 1 wherein a plurality of said strands of said string grid have a cross-section defining a polygon with more than one longitudinally extending concave surface on each side thereof.

5. A tennis racket as claimed in claim 1 wherein said strands of said string grid comprise a single extruded element having rectilinear side surfaces which is woven in said frame to provide said string grid.

6. A tennis racket as claimed in claim 5 wherein said side surfaces of each strand of the arrays of said string grid are rectilinear.

7. A tennis racket as claimed in claim 1 wherein adjacent ones of said concave side surfaces meet to define a sharp longitudinally extending rectilinear edge.

8. A tennis racket as claimed in claim 1 wherein said longitudinally extending side surfaces and said longitudinally extending edges formed thereby are substantially rectilinear.

9. A tennis racket as claimed in claim 1 wherein said strands of said pair of arrays of said string grid are extruded of a resin material conventionally used in racket stringing and said mutually transverse arrays are perpendicular to each other.

* * * * *